US006848398B2

(12) United States Patent
Schmidt et al.

(10) Patent No.: US 6,848,398 B2
(45) Date of Patent: Feb. 1, 2005

(54) TWO-CYCLE ENGINE

(75) Inventors: Olaf Schmidt, Korb (DE); Jörg Schlossarczyk, Winnenden (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 10/319,665

(22) Filed: Dec. 13, 2002

(65) Prior Publication Data

US 2003/0111027 A1 Jun. 19, 2003

(30) Foreign Application Priority Data

Dec. 18, 2001 (DE) ..... 101 62 138

(51) Int. Cl.[7] ..... F02B 33/04
(52) U.S. Cl. ..... 123/73 PP
(58) Field of Search ..... 123/65 P, 73 PP

(56) References Cited

U.S. PATENT DOCUMENTS 5,490,483 A * 2/1996 Tanikake et al. ..... 123/65 P
5,699,761 A * 12/1997 Yamaguchi et al. ..... 123/73 A
5,813,373 A * 9/1998 Schlossarczyk et al. ... 123/65 P
5,870,981 A * 2/1999 Knaus et al. ..... 123/65 A
6,016,776 A * 1/2000 Jonsson ..... 123/65 A
6,223,705 B1 5/2001 Sato et al. ..... 123/73 PP
6,318,311 B1 * 11/2001 Kikuchi ..... 123/73 PP
6,491,005 B2 * 12/2002 Bergmann et al. ..... 123/73 R
6,513,465 B2 * 2/2003 Fukuoka et al. ..... 123/73 PP
6,539,900 B2 * 4/2003 Laimbock ..... 123/73 PP
6,595,168 B2 * 7/2003 Araki ..... 123/73 PP
6,691,649 B2 * 2/2004 Zauner et al. ..... 123/73 B

* cited by examiner

*Primary Examiner*—Hai Huynh
(74) *Attorney, Agent, or Firm*—R W Becker & Associates; Robert W Becker

(57) ABSTRACT

A two-cycle engine is provided and has a cylinder with a combustion chamber delimited by a reciprocating piston. The engine has an inlet for fuel/air mixture, an outlet out of the combustion chamber for exhaust gas, and four transfer channels that open into the cylinder via inlet windows, and fluidically connect the crankcase with the combustion chamber as a function of the piston position. The transfer channels have a connecting portion to the crankcase, an ascending portion substantially parallel to the longitudinal axis of the cylinder, and an opening-out portion into the combustion chamber. The planes defined by that side wall of the transfer channel close to the outlet that is remote from the outlet, and by the side wall of the transfer channel remote from the outlet that is close to the outlet, intersect in a line extending on the side of the mirror plane facing the transfer channels.

29 Claims, 4 Drawing Sheets

TWO-CYCLE ENGINE

BACKGROUND OF THE INVENTION

The present invention relates to a two-cycle engine for a portable, manually-guided implement, such as a power chain saw, a cut-off machine, etc., having a cylinder in which is formed a combustion chamber that is delimited by a reciprocating piston that is connected via a connecting rod with a crankshaft mounted in a crankcase, wherein an inlet is provided for a fuel/air mixture and an outlet is provided out of the combustion chamber for exhaust gas.

U.S. Pat. No. 6,223,705 discloses a two-cycle engine that is provided with four symmetrically arranged transfer channels. The side walls of the transfer channels are respectively symmetrically arranged relative to one another and form prescribed angles, as a result of which a specific scavenging characteristic is to be produced.

There are narrow limits for the freedom of design for the transfer channels, especially with die cast cylinders. In order therefore to satisfy the increasing requirements for low noxious emissions and the power of the engine, cylinders can also be produced via the gravity casting process with lost cores, so that the channels can pretty much have any configuration.

It is an object of the present invention to provide a two-cycle engine of the aforementioned type according to which, while providing high power and low emissions, a complete scavenging of the combustion chamber is ensured.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 2:
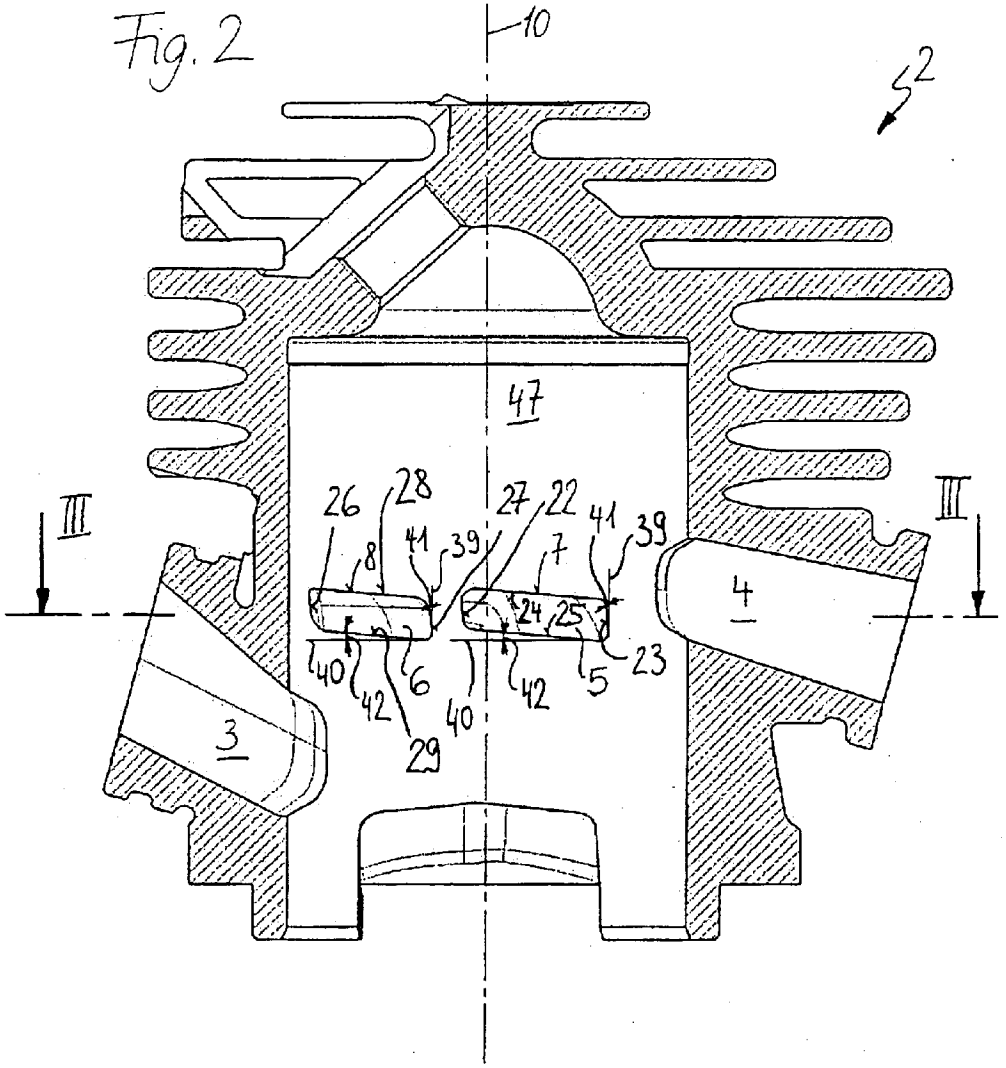
FIG. 2 shows a cross-section through the cylinder of a two-cycle engine.

The object of the present invention is realized with an engine having four transfer channels, which are mirror symmetrical relative to a mirror plane, wherein the transfer channels open into the cylinder via inlet windows and provide fluidic communication between the crankcase and the combustion chamber as a function of the position of the piston; two of the transfer channels are disposed close to the outlet, and two other of the transfer channels are disposed remote from the outlet, wherein the transfer channels are provided with a connecting portion to the crankcase, an ascending portion that is substantially parallel to the longitudinal axis of the cylinder, and an opening-out portion into the combustion chamber; the opening-out portion has a side wall that is close to the outlet, a side wall that is remote from the outlet, a top, and a base, wherein a plane defined by that side wall of the transfer channel disposed close to the outlet that is remote from the outlet, and a plane defined by that side wall of the transfer channel disposed remote from the outlet that is close to the outlet, intersect in a line that extends on a side of the mirror plane that faces the transfer channels.

By disposing the lines of intersection on that side of the mirror plane that faces the transfer channels, turbulence occurs before the fluid streams out of oppositely disposed transfer channels meet one another. This results in a complete scavenging of the combustion chamber.

The line of intersection between that side wall of the transfer channel disposed close to the outlet that is remote from the outlet, and the side wall of the transfer channel disposed remote from the outlet that is close to the outlet, is expediently spaced relative to the mirror plane by 5 to 15%, in particular 10%, of the inner diameter of the cylinder. This spacing is particularly favorable for the formation of turbulence. The side wall of the transfer channel disposed close to the outlet that is remote from the outlet advantageously forms with the side wall of the transfer channel disposed close to the outlet that is remote from the outlet an angle between 5 and 25°, in particular 10°. The relatively small angle between the side walls effects a nearly parallel flow in the region between the discharging fluid streams. The fluid streams do not meet one another violently in the region in the lines of intersection, but rather form turbulence only in the region of contact between line of intersection and mirror plane.

The planes that are fixed by the side walls of the transfer channel disposed close to the outlet that are remote from and close to the outlet expediently intersect in a line that extends toward that side of the mirror plane that faces away from the transfer channels. The line advantageously has a spacing relative to the mirror plane of 20 to 60%, in particular 36%, of the inner diameter of the cylinder. By this design of the side walls, the flow is focused in the horizontal direction. As a consequence, when meeting the flow of the oppositely disposed channel the flow is accelerated in the vertical direction. The spacing of the lines of intersection relative to the mirror plane must, however, be of such a magnitude that a formation of turbulence due to too great of a focusing in the main flow ahead of the mirror plane is avoided. The side walls of the transfer channel that is close to the outlet advantageously form an angle of between 5 and 40°, in particular 20°. An angle of approximately 20° results in a focusing that is particularly favorable for the scavenging property.

The side walls of the transfer channel that is remote from the outlet also intersect in a line on that side of the mirror plane that faces away from the transfer channels. This line of intersection advantageously has a spacing of 50 to 150%, in particular 100%, of the inner diameter of the cylinder relative to the mirror plane. The side walls expediently form an angle of between 1 and 25°, in particular 10°. The angle between the side walls of the transfer channel that is remote from the outlet is smaller than that between the side walls of the transfer channel that is close to the outlet, since the flow from the inner wall of the cylinder is limited laterally. Therefore, already with a slight focusing an adequate acceleration can be achieved in the vertical direction.

Particularly favorable flow conditions result if in a plane of intersection perpendicular to the cylinder axis that side wall of the transfer channel disposed remote from the outlet that is remote from the outlet forms with the mirror plane an angle between 90 and 100°, in particular 95°, that side wall of the transfer channel disposed remote from the outlet that is close to the outlet forms with the mirror plane an angle between 95 and 115°, in particular 105°, that side wall of the transfer channel disposed close to the outlet that is remote from the outlet forms with the mirror plane an angle between 105 and 125°, in particular between 115 and 125°, in particular 115°, and that side wall of the transfer channel close to the outlet that is close to the outlet forms with the rear plane an angle between 125 and 145°, in particular 135°.

The angles relative to the mirror plane, which in particular with the side walls of the transfer channel that is close to the outlet are large in comparison to the state of the art, enable a particularly effective and complete scavenging of the combustion chamber. These angles are difficult to produce in a die cast process, so that to produce a cylinder that is optimized for scavenging, the gravity casting process with lost cores is advantageously utilized. The inlet windows are expediently configured as parallelograms that have no right angles, as a result of which the scavenging pattern is also significantly improved.

The top and base of the opening-out portions of the transfer channels rise in particular in a direction toward the inlet windows. It is particularly expedient if the top of the opening-out portion of the transfer channels that are close to the outlet are inclined by an angle between 0.1 and 5°, in particular 1°, and if the base of the opening-out portion of the transfer channels that are close to the outlet are inclined by an angle between 2 and 10°, in particular 5°. Due to the fact that the base is inclined more markedly than is the top, the fluid in the transfer channel is accelerated, thus improving the scavenging. For the opening-out portion of the transfer channels that are remote from the outlet, the top is inclined by an angle between 10 and 20°, in particular 15°, and the base is inclined by an angle of between 15 and 25°, in particular 20°. As a result of the steeper rising of the transfer channels that are remote from the outlet, the upper region of the combustion chamber is also effectively scavenged.

The top of the opening-out portion of the transfer channels that are close to the outlet advantageously has a length of approximately 6 mm, and merges via a radius of approximately 8 mm into the ascending portion. A length of approximately 4 mm and a merging radius into the ascending portion of approximately 3 mm are advantageous for the base.

For the opening-out portion of the transfer channels that are remote from the outlet, a length of approximately 8 mm and a merging radius in to the ascending portion of approximately 10 mm are provided for the top. The base is provided in particular with a length of approximately 5 mm and merges via a radius of approximately 3 mm into the ascending portion.

The transfer channel that is remote from the outlet is expediently arranged in such a way that the spacing of the point of intersection of the walls that are remote from the outlet with the mirror plane relative to the cylinder axis is between 40 and 50%, in particular approximately 49%, of the inner diameter of the cylinder. The spacing of the point of intersection of the side wall that is close to the outlet with the mirror plane relative to the longitudinal axis of the cylinder is advantageously between 20 and 35%, in particular approximately 28%, of the inner diameter of the cylinder. The transfer channel that is close to the outlet is expediently arranged in such a way that the spacing of the point of intersection of the side wall that is remote from the outlet with the mirror plane relative to the longitudinal axis of the cylinder is between 25 and 35%, in particular approximately 30%, of the inner diameter of the cylinder, and the spacing of the point of intersection of the side wall that is close to the outlet with the mirror plane relative to the longitudinal axis of the cylinder is between 5 and 15%, in particular approximately 11%, of the inner diameter of the cylinder.

For the inlet windows, it is provided that the side walls be inclined by an angle relative to a line that is parallel to the longitudinal axis of the cylinder, and that the top and base be inclined by an angle relative to a line that is perpendicular to the longitudinal axis of the cylinder. As a result, a swirl of the fluid entering the combustion chamber can be produced, which leads to a further improvement of the scavenging effect.

Further specific features of the present invention will be described in detail subsequently.

DESCRIPTION OF PREFERRED EMBODIMENTS

Figure 1:
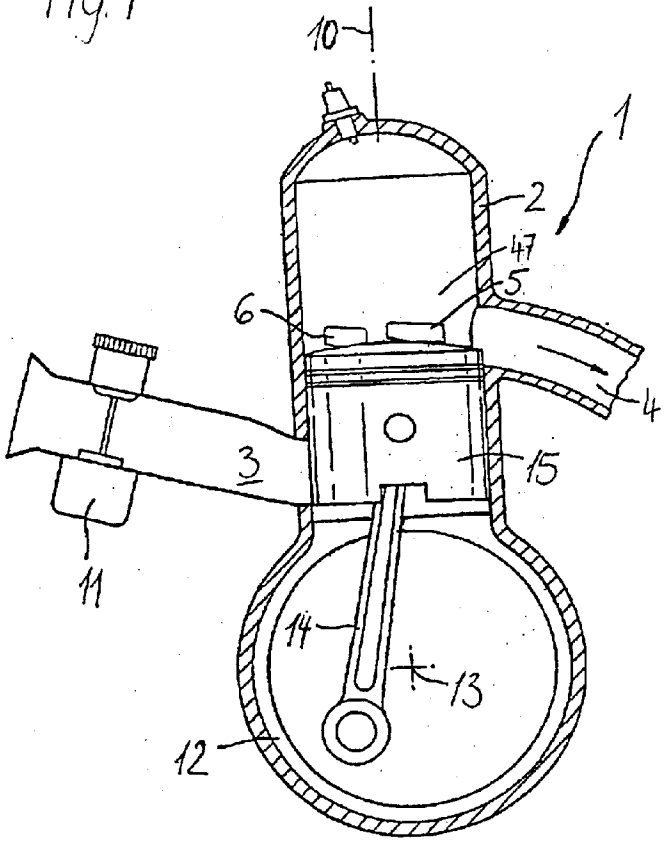
FIG. 1 shows a two-cycle engine.

Referring now to the drawings in detail, the two-cycle engine 1 schematically illustrated in FIG. 1 includes a combustion chamber 47 that is formed in a cylinder 2 and is delimited by a reciprocating piston 15. The two-cycle engine 1 has an inlet 3 that supplies to the crankcase 12 fuel/air mixture from the mixture preparation device 11. The fuel/air mixture is compressed in the crankcase 12 by the descending piston 15, and is conveyed out of the crankcase into the combustion chamber 47 via the transfer channels 5 and 6. The exhaust gas leaves the combustion chamber 47 via the outlet 4. The crankshaft 13 is driven by the connecting rod 14 as a result of the reciprocating movement of the piston 15.

FIG. 2 illustrates a cross-section through the cylinder 2. The transfer channel 5 opens into the combustion chamber 47 via an inlet window 7. The side walls 22 and 23 of the transfer channel 5 are inclined by an angle 41 relative to a line 39 that is parallel to the longitudinal axis 10 of the cylinder 2. As a consequence of this inclination, the top 24 is disposed further from the outlet 4 than is the base 25. The base 25 and the top 24 are inclined by an angle 42 relative to a line 40 that is perpendicular to the longitudinal axis 10 of the cylinder 2, whereby the base 25 drops in a direction towards the outlet 4. The side walls 26 and 27 of the transfer channel 6, which opens into the combustion chamber 47 via the inlet window 8, are similarly inclined by an angle 41 relative to the line 39 that is parallel to the cylinder axis 10. The top 28 and the base 29 are inclined by an angle 42 relative to the line 40 that is perpendicular to the cylinder axis 10.

Figure 3:
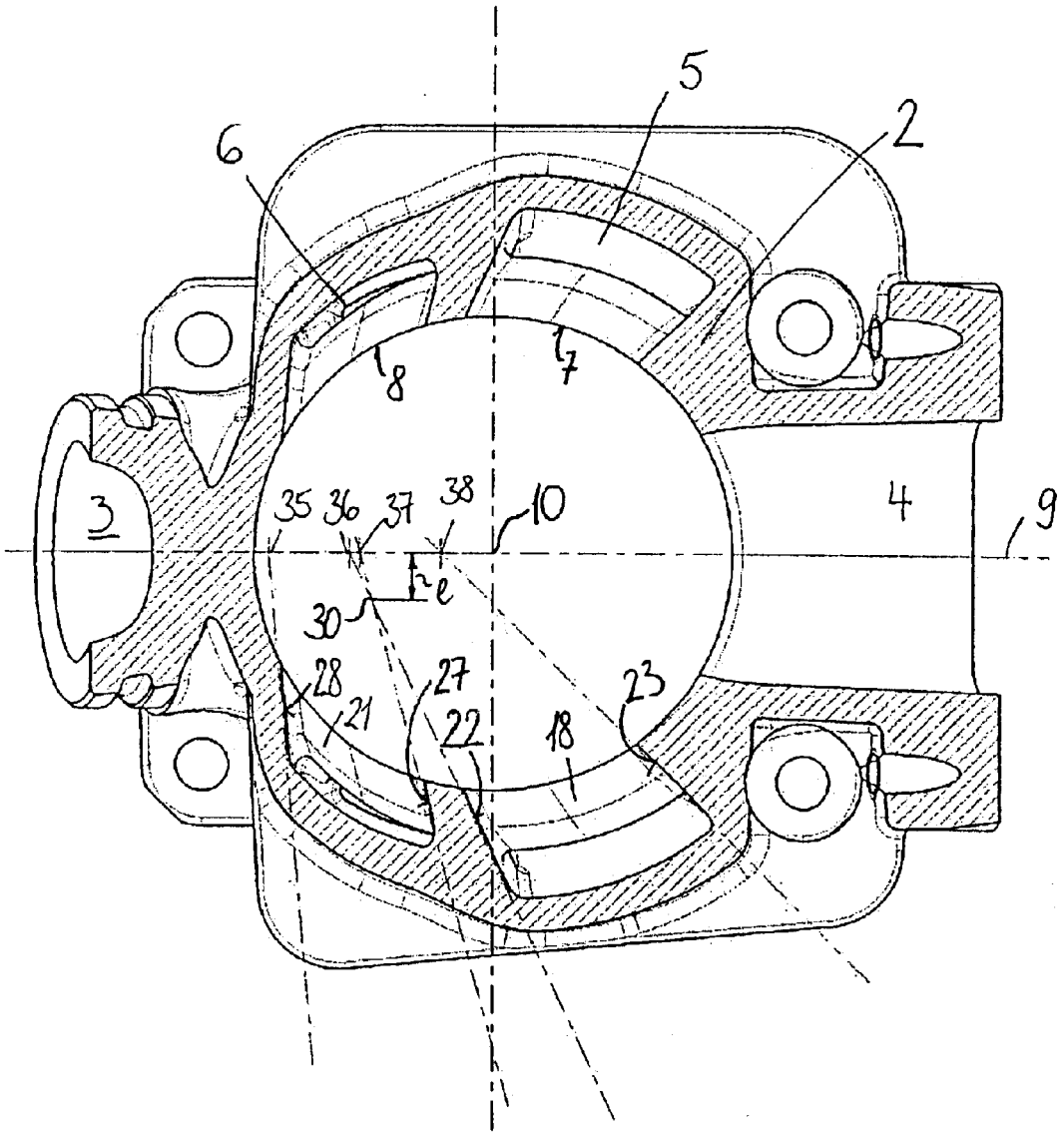
FIG. 3 is a cross-sectional view taken along the line III-III in FIG. 2.
Figure 4:
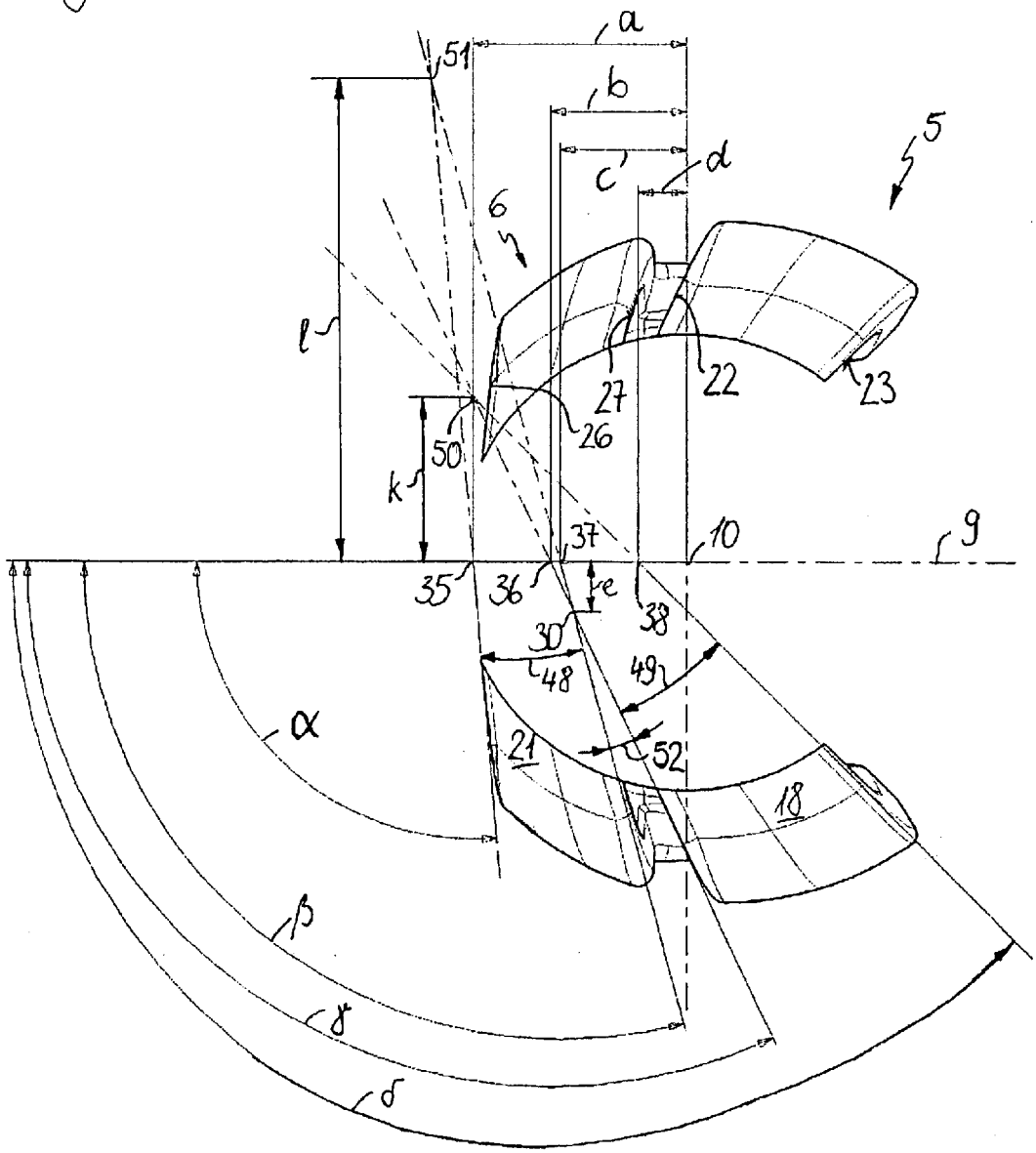
FIG. 4 is a plan view of the transfer channels.

FIG. 3 shows a cross-section taken along the line III—III in FIG. 2, and FIG. 4 shows a corresponding plan view upon the transfer channels 5 and 6. The transfer channels 5,6 have opening-out portions 18,21 that extend nearly perpendicular to the longitudinal axis 10 of the cylinder 2 and which end at the inlet windows 7,8. The side walls 22,23 of the transfer channel 5 that is close to the outlet, and the side walls 26,27 of the transfer channel 6 that is remote from the outlet, intersect the mirror plane 9, which advantageously contains the longitudinal axis 10 of the cylinder 2 in the half of the cylinder that is remote from the outlet 4. The side wall 22 of the transfer channel 5 that is close to the outlet, which side wall 22 itself is remote from the outlet, and the side wall 27 of the transfer channel 6 that is remote from the outlet, which side wall 27 itself is closer to the outlet, intersect in a line of intersection 30 that has a spacing e from the mirror plane 9 of 5 to 15%, especially 10%, of the diameter of the cylinder 2.

In FIG. 4, the points of intersection and the inclination angles of the side walls are illustrated in detail. The side walls 22,23 of the transfer channel 5 that is close to the outlet intersect in the line 50, which has a spacing k from the mirror plane 9 of 20 to 60%, especially 36%, of the inner diameter of the cylinder 2, at an angle 49 of between 5 and 40°, especially 20°. The side walls 26,27 of the transfer channel 6 that is remote from the outlet intersect, at an angle 48 between 1 and 25°, especially 10°, in a line 51, which has a spacing I from the mirror plane 9 of between 50 and 150%, especially 100%, of the inner diameter of the cylinder 2.

The side wall 26 of the transfer channel 6 that is remote from the outlet, which side wall 26 itself is remote from the outlet, forms with the mirror plane 9 an angle β, measured from the inlet 3, that is between 90 and 100°, and in particular is approximately 95°. The spacing a of the point of intersection 35 relative to the longitudinal axis 10 of the cylinder 2 is between 40 and 50%, in particular approximately 49%, of the inner diameter of the cylinder. The side wall 27 of the transfer channel 6 that is remote from the outlet, which side wall 27 is itself close to the outlet, forms with the mirror plane 9 an angle β between 95 and 115°, in particular 105°, whereby the spacing c of the point of intersection 37 relative to the longitudinal axis 10 of the cylinder 2 is between 20 and 35%, in particular approximately 28%, of the inner diameter of the cylinder. The side wall 22 of the transfer channel 5 that is close to the outlet, which side wall 22 itself is remote from the outlet, forms with the mirror plane 9 an angle γ between 105 and 125°, in particular 115°, whereby the point of intersection 36 has a spacing b relative to the longitudinal axis 10 of the cylinder 2 of approximately 25 to 35%, in particular approximately 30%, of the inner diameter of the cylinder. The side wall 23 of the transfer channel 5 that is close to the outlet, which side wall 23 is itself close to the outlet, is inclined relative to the mirror plane 9 by an angle δ between 125 and 145°, in particular about 135°, whereby the point of intersection 38 has a spacing d relative to the longitudinal axis of the cylinder 2 between 5 and 15%, in particular approximately 11%, of the inner diameter of the cylinder.

Figure 5:
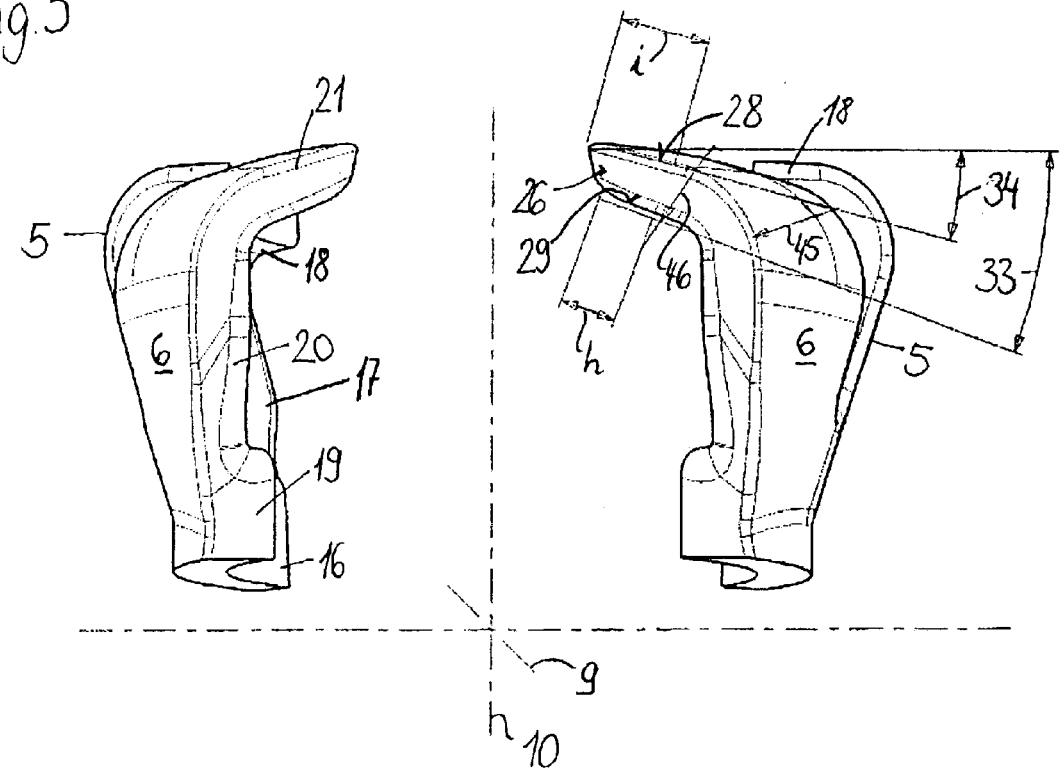
FIG. 5 is a perspective view of the transfer channels.
Figure 6:
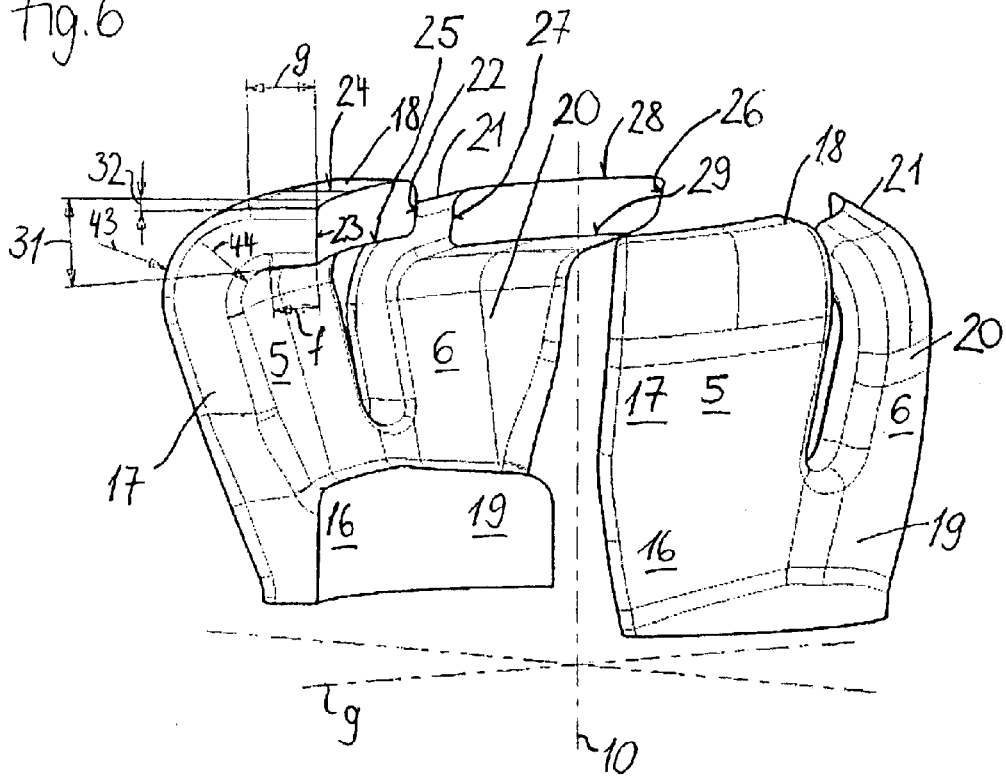
FIG. 6 is a further perspective view of the transfer channels.

FIGS. 5 and 6 show perspective views of the transfer channels 5 and 6. The transfer channels 5,6 each have a connecting portion 16,19 to the crankcase 12, and ascending portion 17,20 that extends substantially parallel to the longitudinal axis 10 of the cylinder 2, as well as the opening-out portion 18,21. The connecting portions 16,19 of the transfer channels 5,6 communicate with one another and merge with one another in the circumferential direction of the cylinder 2. As illustrated in FIG. 5, the base 29 of the opening-out portion 21 is inclined relative to a line that is perpendicular to the longitudinal axis of the cylinder 2 by an angle 33. The angle 33 is advantageously between 15 and 25°, in particular approximately 20°. The base 29 has a length h of approximately 5 mm. The top 28 is inclined relative to a line that is perpendicular to the longitudinal axis 10 of the cylinder 2 by an angle 34 of between 10 and 20°, in particular about 15°, and has a length i of approximately 8 mm. The radius 45 via which the top 28 of the opening-out portion 21 merges into the ascending portion 20 is advantageously approximately 10 mm, and the radius 46 via which the base 29 merges into the ascending portion 20 is approximately 3 mm.

The opening-out portion 18 of the transfer channel 5 that is close to the outlet is, as illustrated in FIG. 6, similarly inclined relative to a line that extends perpendicular to the longitudinal axis 10 of the cylinder 2. The angle 32 between the top 24 and a line that is perpendicular to the longitudinal axis 10 of the cylinder is advantageously between 0.1 and 5°, in particular approximately 1°, and the angle 31 that the base 25 forms with a perpendicular line is advantageously between 2 and 10°, in particular approximately 5°. The top 24 has a length g of approximately 6 mm and advantageously merges via a radius 43 of approximately 8 mm into the ascending portion 17. The base 25 has a length f of approximately 4 mm and merges via a radius 44 of approximately 3 mm into the ascending portion 17.

The indicated length of the opening-out portions 18,21 are particularly advantageous for cylinders that have an inner diameter between 45 and 50 mm. Where the inner diameters of the cylinder deviate from such a diameter, appropriately altered lengths can be advantageous.

The specification incorporates by reference the disclosure of German priority document 101 62 138.8 filed 18 Dec. 2001.

The present invention is, of course, in no way restricted to the specific disclosure of the specification and drawings, but also encompasses any modifications within the scope of the appended claims.

We claim:

1. A two-cycle engine for a portable, manually-guided implement and having a cylinder in which is formed a combustion chamber that is delimited by a reciprocating piston that is connected via a connecting rod with a crankshaft mounted in a crankcase, wherein an inlet is provided or a fuel/air mixture and an outlet is provided out of said combustion chamber for exhaust gas, said engine further comprising:

four transfer channels which are mirror symmetrical relative to a mirror plane, wherein said transfer channels open into said cylinder via inlet windows and provide fluidic communication between said crankcase and said combustion chamber as a function of the position of said piston, wherein two of said transfer channels are disposed close to said outlet, and two of said transfer channels are disposed remote from said outlet, wherein said transfer channels are provided with a connecting portion to said crankcase, an ascending portion that is substantially parallel to a longitudinal axis of said cylinder, and an opening-out portion into said combustion chamber, wherein said opening-out portion has a side wall that is close to said outlet, a side wall that is remote from said outlet, a top, and a base, wherein a plane defined by that side wall of one of said transfer channels disposed close to said outlet that is remote from said outlet, and a plane defined by that side wall of one of said transfer channels disposed remote from said outlet that is close to said outlet, intersect in a line that extends on a side of said mirror plane that faces said transfer channels, wherein said line has a spacing relative to said mirror plane of 5 to 15% of an inner diameter of said cylinder.

2. A two-cycle engine according to claim 1, wherein that side wall of said transfer channel disposed close to said outlet that is remote from said outlet forms with that side wall of said transfer channel disposed remote from said outlet that is close to said outlet an angle of between 5 and 25°.

3. A two-cycle engine according to claim 1, wherein planes defined by those side walls of said transfer channel disposed close to said outlet that are remote from and close to said outlet intersect in a line that extend on a side of said mirror plane that faces away from said transfer channels.

4. A two-cycle engine according to claim 3, wherein said line has a spacing from said mirror plane of 20 to 60% of an inner diameter of said cylinder.

5. A two-cycle engine according to claim 3, wherein those side walls of said transfer channel disposed close to said outlet that are remote from and close to said outlet form an angle of between 5 and 40°.

6. A two-cycle engine according to claim 1, wherein planes formed by those side walls of said transfer channel disposed remote from said outlet that are remote from and close to said outlet intersect in a line that extends on a side of said mirror plane that faces away from said transfer channels.

7. A two-cycle engine according to claim 6, wherein said line has a spacing relative to said mirror plane of 50 to 150% of an inner diameter of said cylinder.

8. A two-cycle engine according to claim 6, wherein those side walls of said transfer channel disposed remote from said outlet that are remote from and close to said outlet form an angle between 1 and 25°.

9. A two-cycle engine according to claim 1, wherein in a plane of intersection that is perpendicular to said longitudinal axis of said cylinder, that side wall of said transfer channel disposed remote from said outlet that is remote from said outlet forms with said mirror plane an angle of between 90 and 100°; that side wall of said transfer channel disposed remote from said outlet that is close to said outlet forms with said mirror plane an angle between 95 and 115°; that side wall of said transfer channel disposed close to said outlet that is remote from said outlet forms with said mirror plane an angle of between 105 and 125°; and that side wall of said transfer channel disposed close to said outlet that is disposed close to said outlet forms with said mirror plane an angle of between 125 and 145°.

10. A two-cycle engine according to claim 1, wherein said inlet windows are configured as parallelograms.

11. A two-cycle engine according to claim 1, wherein at least one of said top and said base of said opening-out portion of at least one of said transfer channels rises in a direction toward said inlet window.

12. A two-cycle engine according to claim 11, wherein said top of said opening-out portion of that transfer channel that is disposed close to said outlet is inclined by an angle of between 0.1 and 5°.

13. A two-cycle engine according to claim 11, wherein said base of said opening-out portion of that transfer channel that is disposed close to said outlet is inclined by an angle of between 2 and 10°.

14. A two-cycle engine according to claim 11, wherein said top of said opening-out portion of that transfer channel that is remote from said outlet in inclined by an angle of between 10 and 20°.

15. A two-cycle engine according to claim 11, wherein said base of said opening-out portion of that transfer channel that is remote from said outlet is inclined by an angle of between 15 and 25°.

16. A two-cycle engine according to claim 1, wherein said top of said opening-out portion of that transfer channel that is disposed close to said outlet has a length of approximately 6 mm.

17. A two-cycle engine according to claim 1, wherein said top of said opening-out portion of that transfer channel that is disposed close to said outlet merges with said ascending portion via a radius of approximately 8 mm.

18. A two-cycle engine according to claim 1, wherein said base of said opening-out portion of that transfer channel that is disposed close to said outlet has a length of approximately 4 mm.

19. A two-cycle engine according to claim 1, wherein said base of said opening-out portion of that transfer channel that is disposed close to said outlet merges into said ascending portion via a radius of approximately 3 mm.

20. A two-cycle engine according to claim 1, wherein said top of said opening-out portion of that transfer channel that is disposed remote from said outlet has a length of approximately 8 mm.

21. A two-cycle engine according to claim 1, wherein said top of said opening-out portion of that transfer channel that is disposed remote from said outlet merges into said ascending portion via a radius of approximately 10 mm.

22. A two-cycle engine according to claim 1, wherein said base of said opening-out portion of that transfer channel that is disposed remote from said outlet has a length of approximately 5 mm.

23. A two-cycle engine according to claim 1, wherein said base of said opening-out portion of that transfer channel that is disposed remote from said outlet merges into said ascending portion via a radius of approximately 3 mm.

24. A two-cycle engine according to claim 1, wherein a spacing of a point of intersection of those side walls of said transfer channel disposed remote from said outlet that are disposed remote from said outlet from said mirror plane is, relative to said longitudinal axis of said cylinder, between 40 and 50% of an inner diameter of said cylinder.

25. A two-cycle engine according to claim 1, wherein a spacing of a point of intersection of those side walls of said transfer channels disposed close to said outlet that are remote from said outlet from said mirror plane is, relative to said longitudinal axis of said cylinder, between 25 and 35% of an inner diameter of said cylinder.

26. A two-cycle engine according to claim 1, wherein a spacing of a point of intersection of those side walls of said transfer channels disposed remote from said outlet that are disposed close to said outlet from said mirror plane is, relative to said longitudinal axis of said cylinder, between 20 and 35% of an inner diameter of said cylinder.

27. A two-cycle engine according to claim 1, wherein a spacing of a point of intersection of those side walls of said transfer channels disposed close to said outlet that are disposed close to said outlet from said mirror plane is, relative to said longitudinal axis of said cylinder, between 5 and 15% of an inner diameter of said cylinder.

28. A two-cycle engine for a portable, manually-guided implement and having a cylinder in which is formed a combustion chamber that is delimited by a reciprocating piston that is connected via a connecting rod with a crankshaft mounted in a crankcase, wherein an inlet is provided for a fuel/air mixture and an outlet is provided out of said combustion chamber for exhaust gas, said engine further comprising:

four transfer channels which are mirror symmetrical relative to a mirror plane, wherein said transfer channels open into said cylinder via inlet window and provide fluidic communication between said crankcase and said combustion chamber as a function of the position of said piston, wherein two of said transfer channels are disposed close to said outlet, and two of said transfer channels are disposed remote from said outlet, wherein said transfer channels are provided with connecting portion to said crankcase, an ascending portion that is substantially parallel to a longitudinal axis of said cylinder, and an opening-out portion into said combustion chamber, wherein said opening-out portion has a side wall that is close to said outlet, a side wall that is remote from said outlet, a top, and a base, wherein said side walls of said opening-out portions are inclined by an angle relative to a line that is parallel to said longitudinal axis of said cylinder, and wherein a plane defined by that side wall of one of said transfer channels disposed close to said outlet that is remote from said outlet, and a plane defined by that side wall of one of said transfer channels disposed remote from said outlet that is close to said outlet, intersect in a line that extends on a side of said mirror plane that faces said transfer channels.

29. A two-cycle engine for a portable, manually-guided implement and having a cylinder in which is formed a combustion chamber that is delimited by a reciprocating piston that is connected via a connecting rod with a crankshaft mounted in a crankcase, wherein an inlet is provided for a fuel/air mixture and an outlet is provided out of said combustion chamber for exhaust gas, said engine further comprising:

four transfer channels which are mirror symmetrical relative to a mirror plane, wherein said transfer channels open into said cylinder via inlet window and provide fluidic communication between said crankcase and said combustion amber as a function of the position of said piston, wherein two of said transfer channels are disposed close to said outlet, and two of said transfer channels are disposed remote from said outlet, wherein said transfer channels are provided with connecting portion to said crankcase, an ascending portion that is substantially parallel to a longitudinal axis of said cylinder, and an opening-out portion into said combustion chamber, wherein said opening-out portion has a side wall that is close to said outlet, a side wall that is remote from said outlet, a top, and a base, wherein said top and said base of said opening-out portion are inclined by an angle relative to a line that is perpendicular to said longitudinal axis of said cylinder, and wherein a plane defined by that side wall of one of said transfer channels disposed close to said outlet that is remote from said outlet, and a plane defined by that side wall of one of said transfer channels disposed remote from said outlet that is close to said outlet, intersect in a line that extends on a side of said mirror plane that faces said transfer channels.

* * * * *